US010344769B2

(12) United States Patent
Mouza et al.

(10) Patent No.: US 10,344,769 B2
(45) Date of Patent: Jul. 9, 2019

(54) CLEARANCE CONTROL BETWEEN ROTATING AND STATIONARY STRUCTURES

(71) Applicant: United Technologies Corporation, Farmington, CT (US)

(72) Inventors: Louis R. Mouza, Haverhill, MA (US); Philip R. Rioux, North Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 407 days.

(21) Appl. No.: 15/212,849

(22) Filed: Jul. 18, 2016

(65) Prior Publication Data

US 2018/0017067 A1 Jan. 18, 2018

(51) Int. Cl.

| | |
|---|---|
| ***F01D 11/18*** | (2006.01) |
| ***F04D 29/08*** | (2006.01) |
| ***F04D 29/52*** | (2006.01) |
| ***F04D 29/02*** | (2006.01) |
| ***F01D 25/24*** | (2006.01) |

(52) U.S. Cl.

CPC ..... *F04D 29/083* (2013.01); *F01D 11/18* (2013.01); *F01D 25/243* (2013.01); *F01D 25/246* (2013.01); *F04D 29/023* (2013.01); *F04D 29/526* (2013.01); *F05D 2300/50212* (2013.01)

(58) Field of Classification Search

CPC .... F01D 11/18; F01D 25/243; F01D 2240/11; F01D 2260/941; F01D 2300/177

See application file for complete search history.

(56) References Cited

U.S. PATENT DOCUMENTS

| | | | | |
|---|---|---|---|---|
| 4,363,599 | A | 12/1982 | Cline | |
| 5,154,575 | A | 10/1992 | Bonner | |
| 5,205,115 | A | 4/1993 | Plemmons | |
| 5,314,303 | A | 5/1994 | Charbonnel | |
| 6,877,952 | B2 | 4/2005 | Wilson | |
| 7,210,899 | B2 * | 5/2007 | Wilson, Jr. ..... | F01D 11/18 415/136 |
| 7,597,537 | B2 | 10/2009 | Bucaro | |
| 8,100,635 | B2 | 1/2012 | Dakowski | |
| 8,126,628 | B2 | 2/2012 | Hershey | |
| 8,523,512 | B2 | 9/2013 | Flanagan | |
| 2004/0219011 | A1 | 11/2004 | Albers | |

(Continued)

OTHER PUBLICATIONS

Scott B. Lattime, "Turbine Engine Clearance Control Systems: Current Practices and Future Directions", NASA Technical Memo 2002-211794, AIAA-2002-3790, Sep. 2002.

(Continued)

*Primary Examiner* — Ninh H. Nguyen

(74) *Attorney, Agent, or Firm* — O'Shea Getz P.C.

(57) ABSTRACT

Aspects of the disclosure are directed to a system of an engine, comprising: a clearance control thermal ring, and a seal ring, where a radial gap with respect to an axial centerline of the engine is formed between a radial end of the clearance control thermal ring and a facing radial surface of the seal ring, where the clearance control thermal ring is made of a first material and the seal ring is made of a second material that is different from the first material, and where a first coefficient of thermal expansion of the first material is less than a second coefficient of thermal expansion of the second material.

19 Claims, 5 Drawing Sheets

(56) References Cited

U.S. PATENT DOCUMENTS

| | | | | |
|---|---|---|---|---|
| 2014/0023480 | A1* | 1/2014 | McCaffrey | F01D 11/16 415/47 |
| 2014/0271147 | A1* | 9/2014 | Uskert | F01D 11/24 415/173.2 |
| 2015/0369077 | A1 | 12/2015 | Klasing | |
| 2016/0123172 | A1 | 5/2016 | Mondal | |
| 2016/0186611 | A1* | 6/2016 | Vetters | F01D 25/246 415/173.2 |

OTHER PUBLICATIONS

Anonymous: "INCOLOY alloy 909—Technical bulletin", Sep. 1, 2004, pp. 1-8, XP055436270, Retrieved from the Internet: URL: http://www.specialmetals.com/assets/smc/documents/alloys/incoloy/incoloy-alloy-909.pdf.

Anonymous: "HAYNES 242 alloy—Brochure", Jan. 1, 2017, pp. 1-18, XP055436276, Retrieved from the Internet: URL: http://haynesintl.com/docs/default-source/pdfs/new-alloy-brochures/high-temperature-alloys/brochures/242-brochure.pdf.

Anonymous: "HAYNES Waspaloy alloy—Brochure", Jan. 1, 2017, pp. 1-7, XP055436277, Retrieved from the Internet: URL: http://haynesintl.com/docs/default-source/pdfs/new-alloy-brochures/high-temperature-alloys/brochures/waspaloy.pdf.

EP Search Report for EP Appln. No. 17180835.5 dated Apr. 11, 2018.

* cited by examiner

CLEARANCE CONTROL BETWEEN ROTATING AND STATIONARY STRUCTURES

BACKGROUND

Gas turbine engines, such as those which power aircraft and industrial equipment, employ a compressor to compress air that is drawn into the engine and a turbine to capture energy associated with the combustion of a fuel-air mixture. Clearances that are maintained between, e.g., rotating and static structure in the engine impact the performance and reliability of the engine. For example, in connection with the compressor, if the (radial) clearance between a blade tip and an engine case is too large there will be a loss of output performance/efficiency. On the other hand, if the clearance between the blade tip and the engine case is too small then the blade tip may rub against the engine case (or a seal disposed between the blade tip and the engine case), which may cause the components to wear over time.

The clearance is a function of various parameters. For example, materials that are used in the construction of a component impact the rate of thermal growth/expansion of that component. Components that are closer to the engine centerline tend to be exposed to elevated temperatures relative to those components located further outward or radially distant from the centerline and hence tend to experience greater degrees of growth/deflection for a given material. Still further, the operative state of the engine (or the associated aircraft, where applicable) may impact the loads that a given component experiences at a given point in time; for example, an increase in load may be experienced by a component during acceleration relative to a steady state operation.

In short, what is needed are techniques to control the degree of growth/expansion of a component under various loads (e.g., thermal loads) in order to be able to tailor a profile of a clearance over various operative states of an engine.

BRIEF SUMMARY

The following presents a simplified summary in order to provide a basic understanding of some aspects of the disclosure. The summary is not an extensive overview of the disclosure. It is neither intended to identify key or critical elements of the disclosure nor to delineate the scope of the disclosure. The following summary merely presents some concepts of the disclosure in a simplified form as a prelude to the description below.

Aspects of the disclosure are directed to a system of an engine, comprising: a clearance control thermal ring, and a seal ring, where a radial gap with respect to an axial centerline of the engine is formed between a radial end of the clearance control thermal ring and a facing radial surface of the seal ring, where the clearance control thermal ring is made of a first material and the seal ring is made of a second material that is different from the first material, and where a first coefficient of thermal expansion of the first material is less than a second coefficient of thermal expansion of the second material. In some embodiments, the clearance control thermal ring and the seal ring define a first radial gap during a first loading condition. In some embodiments, the first loading condition is associated with a steady state operation of the engine. In some embodiments, the radial gap is located radially inward of the clearance control thermal ring. In some embodiments, the radial gap is located radially outward of the seal ring. In some embodiments, the clearance control thermal ring and the seal ring are in contact with one another during a second loading condition. In some embodiments, the second loading condition is associated with acceleration of the engine. In some embodiments, the first material is a first nickel-based alloy and the second material is a second nickel-based alloy. In some embodiments, the first material includes at least one of Haynes® 242 alloy or Incoloy®909 alloy and the second material includes Waspaloy® alloy. In some embodiments, the system further comprises a seal coupled to the clearance control thermal ring. In some embodiments, the seal includes a flange, the system comprising: a bolt and a nut that connect the clearance control thermal ring to the flange. In some embodiments, the clearance control thermal ring includes a slotted hole that seats the bolt. In some embodiments, the system further comprises at least one of a washer or a sleeve disposed between the clearance control thermal ring and a head of the bolt. In some embodiments, the seal is coupled to a stator at an axially forward end of the seal and a guide vane at an axially aft end of the seal. In some embodiments, the clearance control thermal ring includes a first leg and a second leg. In some embodiments, the first leg is substantially oriented in a radial direction and the second leg is substantially oriented in an axial direction. In some embodiments, the clearance control thermal ring is substantially L-shaped.

Aspects of the disclosure are directed to an apparatus comprising: a clearance control thermal ring, a seal ring, and a bolt and a nut that attach the clearance control thermal ring to the seal ring, where the clearance control thermal ring and the seal ring form at least one radial gap with respect to an axial centerline of an engine during a first loading condition, and where the clearance control thermal ring and the seal ring have respective first and second coefficients of thermal expansion that are different from one another such that the at least one radial gap is closed during a second loading condition that is different from the first loading condition. In some embodiments, the at least one radial gap is located radially inward of the clearance control thermal ring.

BRIEF DESCRIPTION OF THE DRAWINGS

The present disclosure is illustrated by way of example and not limited in the accompanying figures in which like reference numerals indicate similar elements. The drawings are not necessarily drawn to scale unless specifically indicated otherwise.

DETAILED DESCRIPTION

Figure 1:
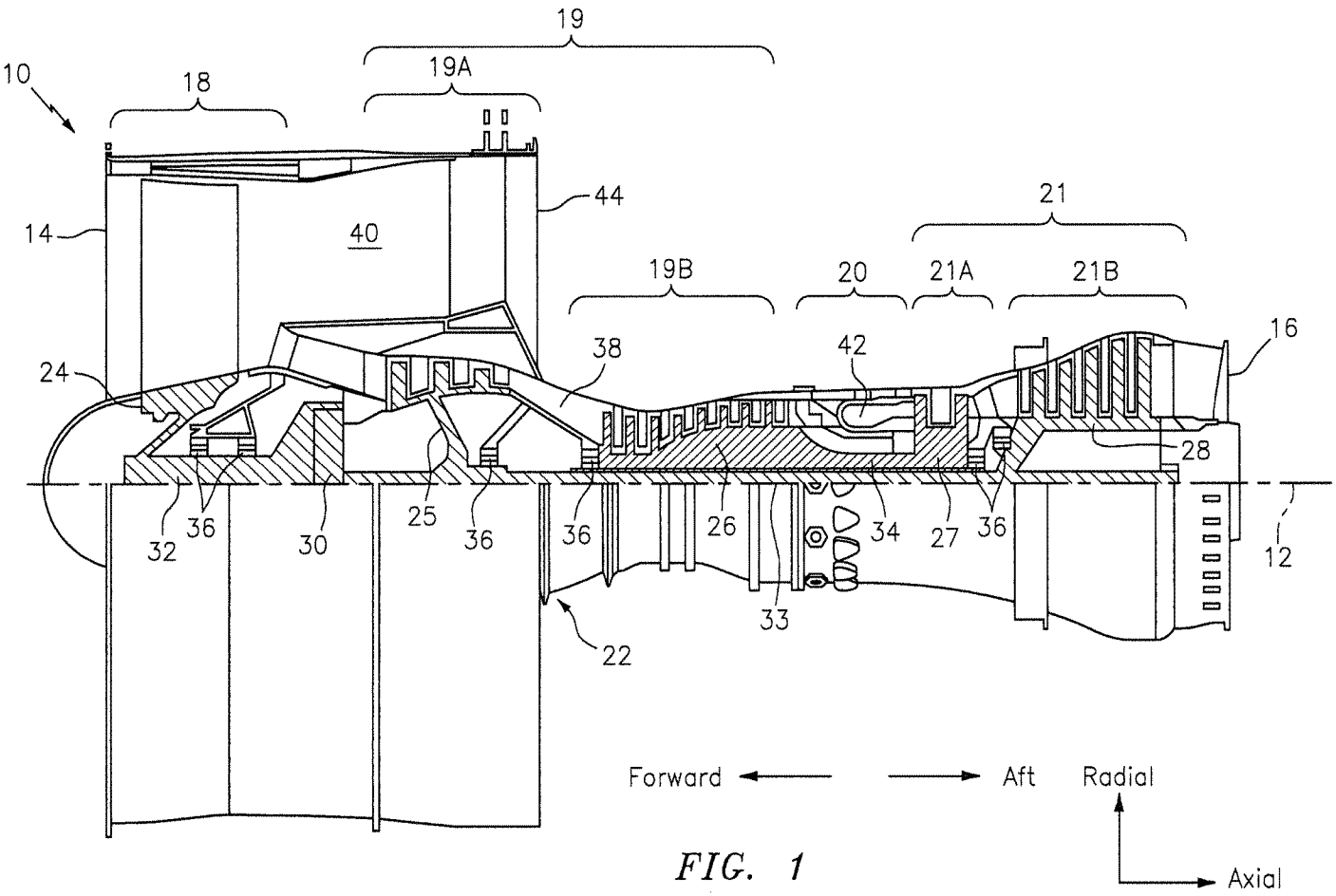
FIG. 1 is a side cutaway illustration of a geared turbine engine.

It is noted that various connections are set forth between elements in the following description and in the drawings (the contents of which are included in this disclosure by way of reference). It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities.

In accordance with aspects of the disclosure, apparatuses, systems, and methods are directed to a clearance control thermal ring. The clearance control thermal ring may be coupled to a flange, such as for example a flange of an outer air seal. The clearance control thermal ring may control thermal growth of an aft seal ring. For example, the clearance control thermal ring may limit continued thermal growth of an aft seal ring beyond a threshold, thereby providing for a tailoring in terms of a clearance profile.

Aspects of the disclosure may be applied in connection with a gas turbine engine. FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. Each of the engine sections 18-19B, 21A and 21B includes a respective rotor 24-28. Each of these rotors 24-28 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 24 is connected to a gear train 30, for example, through a fan shaft 32. The gear train 30 and the LPC rotor 25 are connected to and driven by the LPT rotor 28 through a low speed shaft 33. The HPC rotor 26 is connected to and driven by the HPT rotor 27 through a high speed shaft 34. The shafts 32-34 are rotatably supported by a plurality of bearings 36; e.g., rolling element and/or thrust bearings. Each of these bearings 36 is connected to the engine housing 22 by at least one stationary structure such as, for example, an annular support strut.

During operation, air enters the turbine engine 10 through the airflow inlet 14, and is directed through the fan section 18 and into a core gas path 38 and a bypass gas path 40. The air within the core gas path 38 may be referred to as "core air". The air within the bypass gas path 40 may be referred to as "bypass air". The core air is directed through the engine sections 19-21, and exits the turbine engine 10 through the airflow exhaust 16 to provide forward engine thrust. Within the combustor section 20, fuel is injected into a combustion chamber 42 and mixed with compressed core air. This fuel-core air mixture is ignited to power the turbine engine 10. The bypass air is directed through the bypass gas path 40 and out of the turbine engine 10 through a bypass nozzle 44 to provide additional forward engine thrust. This additional forward engine thrust may account for a majority (e.g., more than 70 percent) of total engine thrust. Alternatively, at least some of the bypass air may be directed out of the turbine engine 10 through a thrust reverser to provide reverse engine thrust.

FIG. 1 represents one possible configuration for an engine 10. Aspects of the disclosure may be applied in connection with other environments, including additional configurations for gas turbine engines. Aspects of the disclosure may be applied in connection with non-geared engines.

Figure 2:
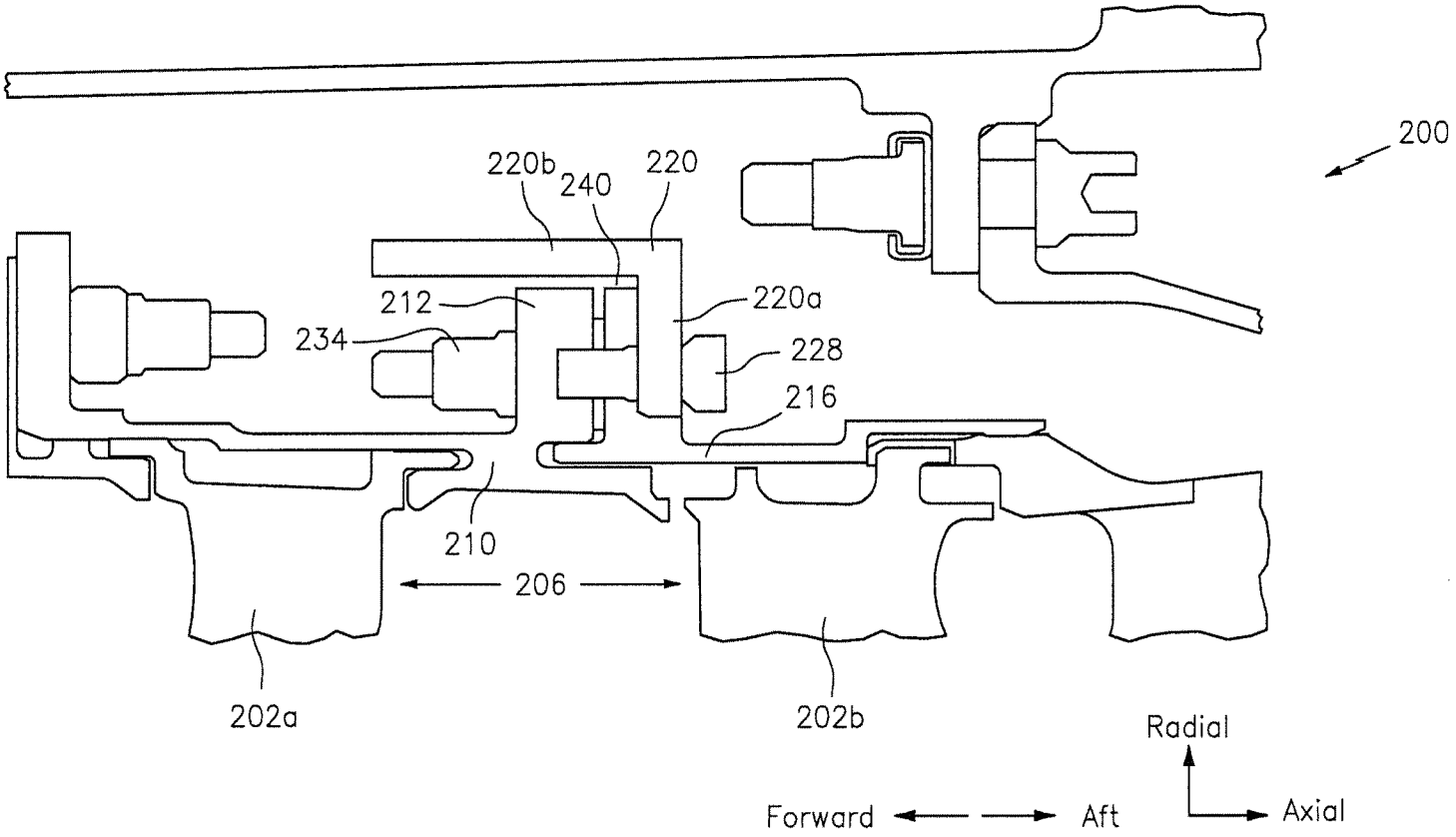
FIG. 2 illustrates an architecture incorporating a clearance control thermal ring coupled to a flange of a seal.

Referring to FIG. 2, a system architecture 200 of an engine (e.g., the engine 10 of FIG. 1) is shown. The system 200 may be associated with one or more portions of the engine, such as for example a stage of a compressor section of the engine.

The system 200 is shown as including structures 202*a* and 202*b*. In one exemplary embodiment, the structure 202*a* may be a fixed structure/stator and the structure 202*b* may be a guide vane. The axially-oriented gap/cavity 206 between the structures 202*a* and 202*b* may accommodate a blade and an associated rotor or an integrally bladed rotor (IBR). An outer air seal 210 may be substantially axially located between the structures 202*a* and 202*b*.

The seal 210 (e.g., a flange 212 of the seal 210 that projects radially outward) may be coupled to an aft seal ring 216. The aft seal ring 216 may be radially and/or axially coupled to an inner diffuser case at the aft end via one or more coupling techniques (e.g., interference fit, use of a bolt, etc.). The aft seal ring 216 may be coupled to a clearance control thermal ring (CCTR) 220. A bolt 228 and a nut 234 may be used for coupling (e.g., attaching) the CCTR 220 and the flange 212 to one another as shown in FIG. 2. In some embodiments, the bolt 228 may axially attach the aft seal ring 216 to the seal 210/flange 212 and a shim may be sandwiched between them. In some embodiments, the aft seal ring 216 may be radially coupled to the seal 210 via a radial interference fit or any other type of radial coupling (e.g., radial attachment); the location of the radial coupling may occur where the aft seal ring 216 physically meets the seal 210 at the inner diameter of the flange 212.

The CCTR 220 may be composed of two or more legs, such as for example a first leg 220*a* and a second leg 220*b*. The first leg 220*a* may be oriented substantially radially and the second leg 220*b* may be oriented substantially axially with respect to the axial centerline 12 (FIG. 1) of the engine, such that the CCTR 220 may assume an L-shaped form factor.

The blade (or the associated rotor) located in, e.g., the gap 206 may tend to grow and contract based on thermal loading over the various operational states of the engine. To accommodate the radially outward growth, it may be desirable for the aft seal ring 216 to grow radially outward as well to prevent/minimize/reduce rubbing/wear between the blade and the seal 210. On the other hand, if an excessive amount/degree of growth is experienced by the aft seal ring 216 then an excessively large radial gap may be formed between the blade and the seal 210, which may result in a loss of engine efficiency/performance. Thus, if the growth of the blade/rotor can be substantially matched to the effective growth of the aft seal ring 216 then a compromise can be made between potential wear on the one hand and performance on the other hand.

Figure 5B:
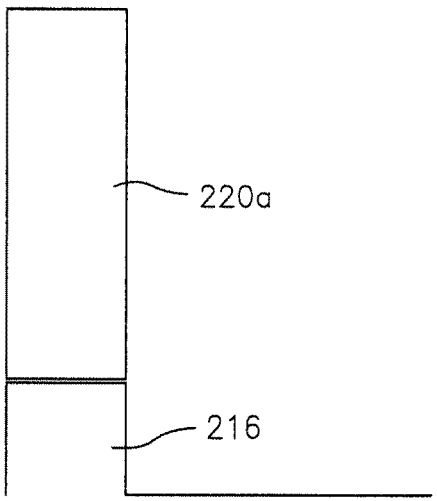
FIGS. 5A-5B illustrate interfaces between a leg of a clearance control thermal ring and an aft seal ring.
Figure 5B:
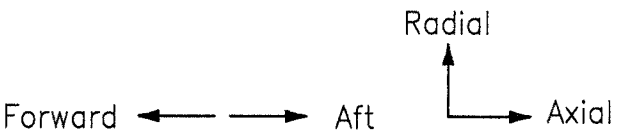
Figure 5A:
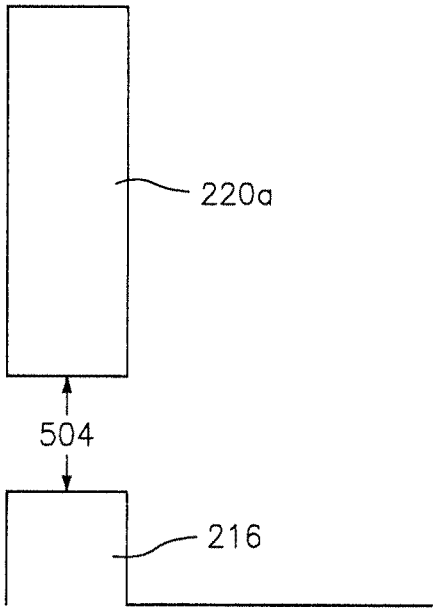
Figure 5A:
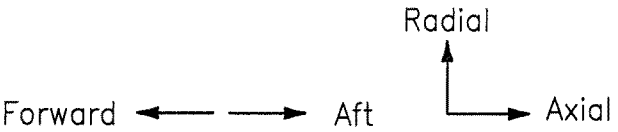

Referring to FIGS. 5A-5B, a closer view of the interface between the leg 220*a* and the aft seal ring 216 is shown. In particular, as shown in FIG. 5A, during steady state operations a radial gap 504 may be defined between the first leg 220*a* of the CCTR 220 and the aft seal ring 216. As the thermal loading increases, such as for example during aircraft acceleration, the aft seal ring 216 may grow radially outward at a rate that is faster than a rate at which the first leg 220*a* grows. As shown in FIG. 5B, due to this difference in rates of thermal growth, the aft seal ring 216 may eventually contact the (radially inward end) of the first leg 220*a* (e.g., the gap 504 may be zero in FIG. 5B), such that any further radial outward growth of the aft seal ring 216 may be limited by the outward growth of the first leg 220*a*.

While FIGS. 2 and 5B illustrate the aft seal ring 216 contacting the CCTR 220 at the radially inward end of the first leg 220*a* (e.g., the gap 504 is radially inward of the CCTR 220), FIG. 2 illustrates a secondary location/gap 240 that can serve a similar purpose/function as the gap 504 described above. For example, the gap 240 (which may be non-zero valued under loading that is less than a threshold and may be located radially outward of the aft seal ring 216) may be made equal to zero under (elevated) loads in a manner similar to the closing of the gap 504 in the transition from FIG. 5A to FIG. 5B described above. Use of the gap 240 (potentially in lieu of the gap 504) may accommodate CCTR 220 materials that cannot be exposed to elevated temperatures.

The rate at which the gap 504 (or the gap 240) decreases under thermal loading may be based on the materials that are used in the construction of one or more of the aft seal ring 216, the CCTR 220, the bolt 228, and the nut 234. For example, the CCTR 220 may be made of a material that has a coefficient of thermal expansion that is less than a coefficient of thermal expansion associated with the aft seal ring 216. In an exemplary embodiment, the aft seal ring 216 may be made of a first nickel-based alloy, such as Waspaloy® alloy, whereas the CCTR 220 may be made of a second nickel-based alloy, such as Haynes® 242 alloy or Incoloy® 909 alloy.

Figure 3:
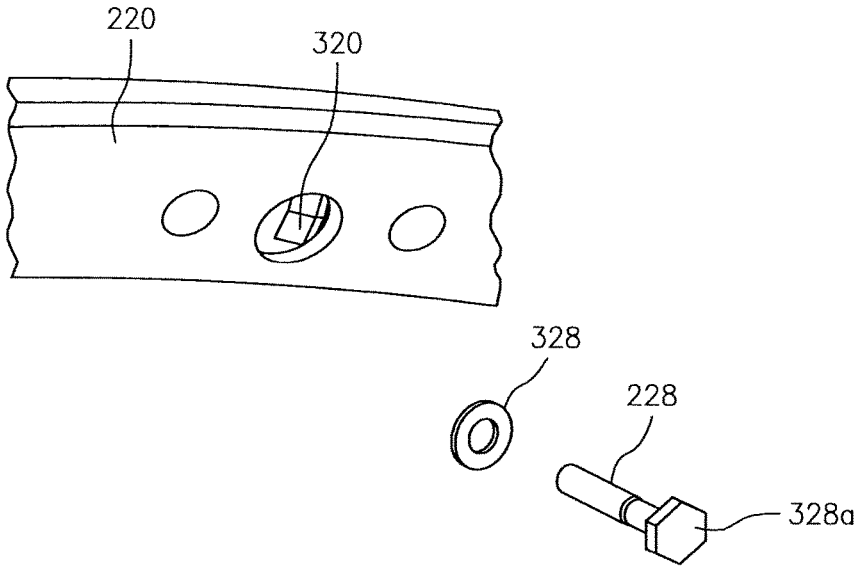
FIG. 3 illustrates a clearance control thermal ring with a slotted radial hole.

Referring to FIG. 3, a closer view of the CCTR 220 in relation to the bolt 228 is shown. The CCTR 220 may include one or more slotted bolt holes, such as for example a hole 320, for accommodating/seating the bolt 228. The hole 320 may allow the CCTR 220 to grow radially over the various operational states of the engine. A flat washer or sleeve, such as the washer 328, may be used to maintain a bearing surface with a head 328*a* of the bolt 228.

Figure 4:
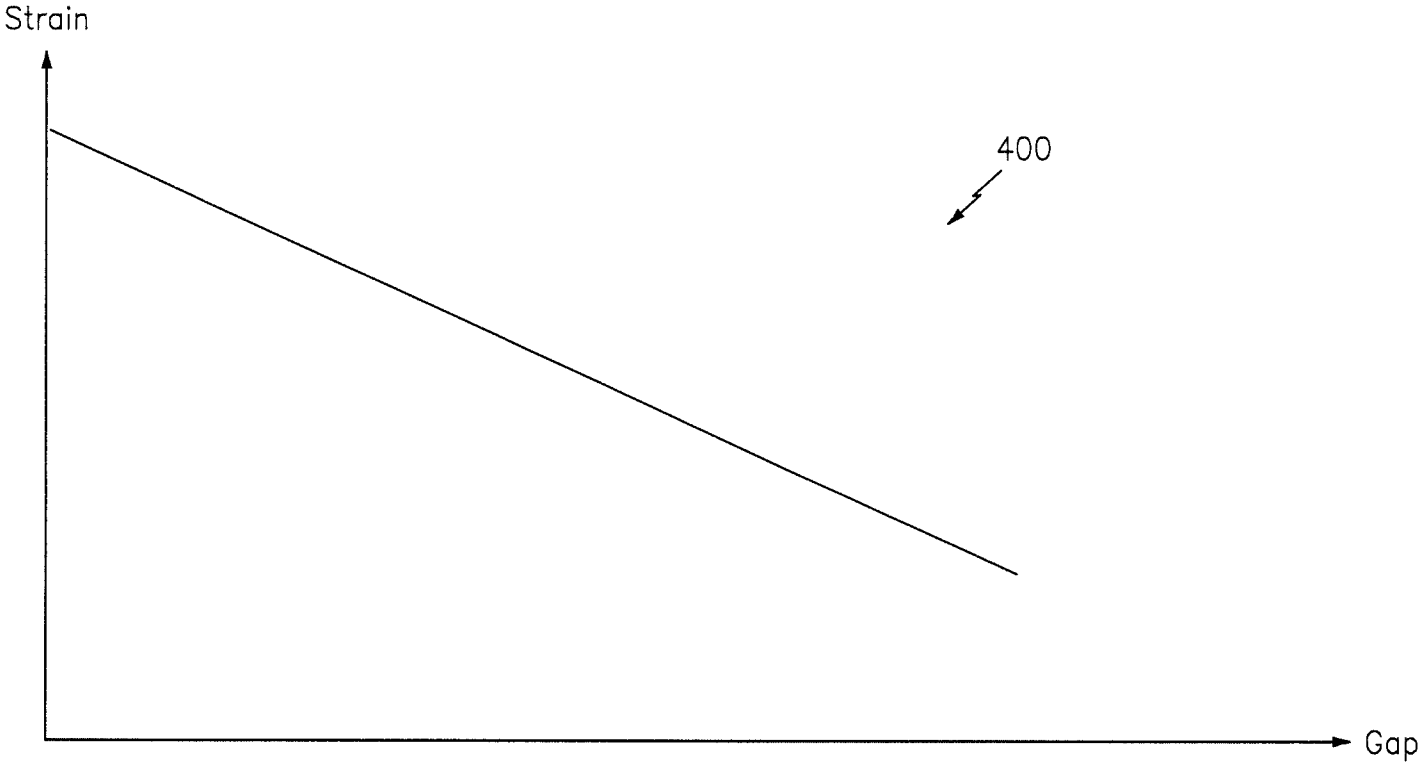
FIG. 4 illustrates a plot of stress on bolt holes of a clearance control thermal ring.

FIG. 4 illustrates a plot 400 of the strain imposed on the hole 320 of FIG. 3 as a function of the gap (e.g., the gap 240 [FIG. 2] or the gap 504 [FIG. 5A]) between the aft seal ring 216 and the CCTR 220. As reflected by the inverse relationship shown in the plot 400, as the gap increases the strain imposed on the hole 320 decreases. Of course, if the gap is made too large then the performance benefit of maintaining a tight clearance between the rotating and stationary hardware provided by the use of the CCTR 220 will not be realized.

Technical effects and benefits of this disclosure include a sealing arrangement that maintains a target tolerance in terms of clearance between rotating and stationary hardware. The use of a CCTR may limit an extent to which a seal ring is allowed to grow to maintain such a target clearance.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional in accordance with aspects of the disclosure. One or more features described in connection with a first embodiment may be combined with one or more features of one or more additional embodiments.

What is claimed is:

1. A system of an engine, comprising:

a clearance control thermal ring;

a seal coupled to the clearance control thermal ring; and a seal ring, wherein a radial gap with respect to an axial centerline of the engine is formed between a radial end of the clearance control thermal ring and a facing radial surface of the seal ring, wherein the clearance control thermal ring is made of a first material and the seal ring is made of a second material that is different from the first material, and wherein a first coefficient of thermal expansion of the first material is less than a second coefficient of thermal expansion of the second material.

2. The system of claim 1, wherein the clearance control thermal ring and the seal ring define a first radial gap during a first loading condition.

3. The system of claim 2, wherein the first loading condition is associated with a steady state operation of the engine.

4. The system of claim 2, wherein the clearance control thermal ring and the seal ring are in contact with one another during a second loading condition.

5. The system of claim 4, wherein the second loading condition is associated with acceleration of the engine.

6. The system of claim 1, wherein the radial gap is located radially inward of the clearance control thermal ring.

7. The system of claim 1, wherein the radial gap is located radially outward of the seal ring.

8. The system of claim 1, wherein the first material is a first nickel-based alloy and the second material is a second nickel-based alloy.

9. The system of claim 8, wherein the first material includes at least one of Haynes® 242 alloy or Incoloy® 909 alloy and the second material includes Waspaloy® alloy.

10. The system of claim 1, wherein the seal includes a flange, the system comprising:

a bolt and a nut that connect the clearance control thermal ring to the flange.

11. The system of claim 10, wherein the clearance control thermal ring includes a slotted hole that seats the bolt.

12. The system of claim 11, further comprising:

at least one of a washer or a sleeve disposed between the clearance control thermal ring and a head of the bolt.

13. The system of claim 1, wherein the seal is coupled to a stator at an axially forward end of the seal and a guide vane at an axially aft end of the seal.

14. The system of claim 1, wherein the clearance control thermal ring includes a first leg and a second leg.

15. The system of claim 14, wherein the first leg is substantially oriented in a radial direction and the second leg is substantially oriented in an axial direction.

16. The system of claim 14, wherein the clearance control thermal ring is substantially L-shaped.

17. An apparatus comprising:

a clearance control thermal ring;

a seal ring; and a bolt and a nut that attach the clearance control thermal ring to the seal ring, wherein the clearance control thermal ring and the seal ring form at least one radial gap with respect to an axial centerline of an engine during a first loading condition, and wherein the clearance control thermal ring and the seal ring have respective first and second coefficients of thermal expansion that are different from one another such that the at least one radial gap is closed during a second loading condition that is different from the first loading condition.

18. The apparatus of claim 17, wherein the at least one radial gap is located radially inward of the clearance control thermal ring.

19. A system of an engine, comprising:

a clearance control thermal ring; and a seal ring, wherein a radial gap with respect to an axial centerline of the engine is formed between a radial end of the clearance control thermal ring and a facing radial surface of the seal ring, wherein the clearance control thermal ring is made of a first material and the seal ring is made of a second material that is different from the first material, and wherein a first coefficient of thermal expansion of the first material is less than a second coefficient of thermal expansion of the second material, wherein the clearance control thermal ring and the seal ring define a first radial gap during a first loading condition, wherein the clearance control thermal ring and the seal ring are in contact with one another during a second loading condition.

* * * * *